US005522164A

United States Patent [19]

Fallon

[11] Patent Number: 5,522,164

[45] Date of Patent: Jun. 4, 1996

[54] DEVICE FOR DISPLAYING A ROTARY BRUSH FOR SALE

[75] Inventor: Régis Fallon, Le Perreux, France

[73] Assignee: La Francaise Metallurgie Societe Anonyme, Paris, France

[21] Appl. No.: 247,755

[22] Filed: May 23, 1994

[30] Foreign Application Priority Data

May 26, 1993 [FR] France ..... 93 06319

[51] Int. Cl.[6] ..... G09F 3/08

[52] U.S. Cl. ..... 40/314; 40/642

[58] Field of Search ..... 40/314, 631, 642, 40/661; 14/116, 199; 15/176.3

[56] References Cited

U.S. PATENT DOCUMENTS

| | | | |
|---|---|---|---|
| D. 173,461 | 11/1954 | Schaefer | D4/116 |
| 591,171 | 10/1897 | Lewis | 40/642 |
| 1,152,461 | 9/1915 | Wright | 40/642 X |
| 2,251,857 | 8/1941 | Rose | 15/176.3 |
| 2,261,285 | 11/1941 | Purinton | 40/631 X |
| 2,700,547 | 1/1955 | Kraeling, Jr. | 40/642 X |
| 2,930,155 | 3/1960 | Becker | 40/631 X |
| 3,076,217 | 2/1963 | Scholl . | |
| 3,562,843 | 2/1971 | Belicka et al. . | |
| 4,134,222 | 1/1979 | Orsos | 40/606 |
| 4,337,678 | 7/1982 | Mumford | 81/3.4 |
| 4,768,402 | 9/1988 | Kele | 81/3.4 |

FOREIGN PATENT DOCUMENTS

| | | | |
|---|---|---|---|
| 438217 | 12/1926 | Germany | 40/314 |

*Primary Examiner*—Kenneth J. Dorner
*Assistant Examiner*—Joanne Silbermann
*Attorney, Agent, or Firm*—Dennison, Meserole, Pollack & Scheiner

[57] ABSTRACT

A device comprises a sheet bearing informational material relating to a rotary brush and includes a threaded rod fastened to one edge of the advertising material. The opposite end of the rod is secured into a threaded opening provided in the tool for connection with a threaded shaft of a driving apparatus in such a manner that the sheet of advertising material is erect when the brush is positioned on its working face.

8 Claims, 1 Drawing Sheet

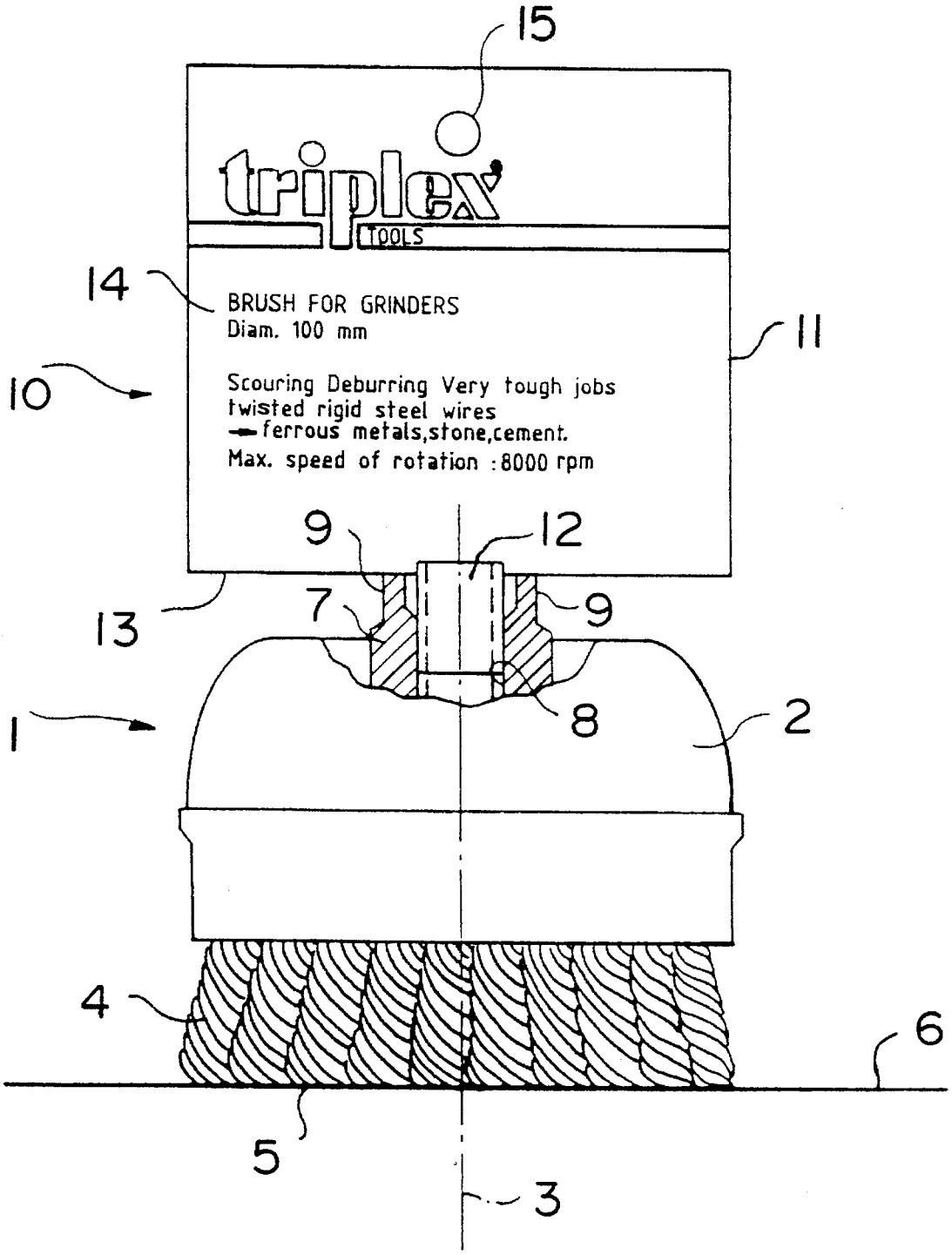
15
triplex
TOOLS
14
BRUSH FOR GRINDERS
Diam. 100 mm
11
10
Scouring Deburring Very tough jobs
twisted rigid steel wires
ferrous metals,stone,cement.
Max. speed of rotation : 8000 rpm
9
12
13
7
9
8
1
2
4
6
5
3

DEVICE FOR DISPLAYING A ROTARY BRUSH FOR SALE

BACKGROUND OF THE INVENTION

The invention relates to a device for the display, at places of sale, of a rotary tool, especially a brush for a grinder. The tool has a working face which may also serve as a rest face by which the tool rests on a horizontal receiving surface, and a hole for fixing it to a rotational driving apparatus, which hole is located opposite the working face and the axis of which is perpendicular to the latter.

Brushes for grinders are currently displayed in parallel-epipedal cardboard boxes to which are affixed messages necessary for identifying them and for indicating their characteristics. These boxes are not very esthetic and not very appealing to the consumer. In addition, the consumer likes to see the brush and to touch its bristles in order to gather tactile information. In order to do this he has to open the box and run the risk of incorrectly closing it, or of not closing it at all, thereby leading to disarray on the shelf.

OBJECTS OF THE INVENTION

The object of the invention is to overcome this drawback, and to propose an attractive display device enabling the consumer to see the tool freely and to touch it without impairing the quality of the display.

SUMMARY OF THE INVENTION

The invention relates to a device of the kind defined in the background and provides for it to comprise means of connection with the fixing hole so as to extend upward from the tool when the latter is laid on its working face.

Other, complementary or alternative characteristics of the device according to the invention are disclosed hereinbelow:

— the connection means comprise a threaded rod for interacting with a threaded fixing hole;

— it comprises a vertical sheet bearing an informative message about the tool;

— the threaded rod is arranged so as to project over the lower edge of the vertical sheet;

— it comprises means of hooking onto a hook or a hanging rod.

The subject of the invention is also an assembly comprising a rotary tool having a working face, which may also serve as a rest face by which the tool rests on a horizontal receiving surface, and a hole for fixing it to a rotational driving apparatus, which hole is located opposite the working face and the axis of which is perpendicular to the latter, and a device such as defined hereinabove, the connection means of which interact with the hole for fixing the tool.

BRIEF DESCRIPTION OF THE DRAWINGS

The single figure is an elevational view of a rotary brush and a vertical sheet mounted thereon.

DETAILED DESCRIPTION OF THE INVENTION

The characteristics and advantages of the invention will be explained in more detail in the description hereinbelow, referring to the appended drawing, the single figure of which is an elevation view, in partial axial section, of a rotary brush for a grinder, fitted with a device according to the invention.

The brush 1 comprises a body 2 of revolution about a vertical axis 3, in which is fixed a bundle of bristles 4 projecting beyond the lower axial end of the body and formed by twisted steel wires. The free ends of the wires define a lower plane face 5 of the brush, which rests on a horizontal receiving surface 6 such as the bottom of a tray containing a multiplicity of brushes on a sales surface.

The body 2 is fitted at its upper end with a connector 7 having a threaded axial hole 8 emerging, on the one hand, at the upper end of the connector 7 and, on the other hand, into an internal cavity, not shown, of the body. The threaded hole 8 is intended to interact with the threaded output shaft of a grinder for the rotational driving of the brush. The connector 7 has two diametrically opposed flats 9 for clamping the brush onto the grinder by means of an open-end wrench.

The display device according to the invention, designated by the reference 10, is formed by a rectangular vertical sheet 11 and by a threaded rod 12, the axis 3 of which lies in the plane of the sheet, this rod projecting downward from the lower edge 13 of the sheet. The sheet and the rod may be joined, for example by welding, or may be formed by a single piece, for example made of a molded plastic. The rod 12 is screwed into the threaded hole 8, the lower edge 13 of the sheet resting on the upper end of the connector 7. At least one of the faces of the sheet bears information 14 relating to the brush. At its upper part, the sheet 11 furthermore has a through-hole 15 making it possible to hang up the assembly formed by the brush 1 and the device 10 instead of laying it down on the bristles 4.

In the case of a non-threaded fixing hole, the connection means may interact with the latter, for example by friction or by clicking-in.

I claim:

1. A device for the display of advertising material associated with a rotary tool at places of sale comprising: a brush, said brush including a body of revolution having a vertical axis and a substantially flat working face configured for support on a planar surface, the brush body being provided with means defining an axial upwardly extending opening located opposite said flat working face for advertising material and connection means for the advertising material, a lower portion of the connection means being positioned within the upwardly extending opening in said brush body and an upper portion of said connection means including a sheet bearing said advertising material.

2. The device as claimed in claim 1 wherein said upwardly extending opening is threaded and the connection means lower portion is a threaded rod for interacting with the threaded extending opening.

3. The device as claimed in claim 2 wherein the threaded rod is configured to connect with a lower edge of the sheet for support thereof.

4. The device as claimed in claim 1 wherein said advertising material comprises an informative message about the rotary brush.

5. The device as claimed in claim 1, wherein the sheet includes means to hang up the device.

6. For the display on a horizontal receiving surface at a place of sale, an assembly comprising a rotary tool having a flat working face, said flat working face serving as a surface on which the tool rests on the horizontal receiving surface, means defining an opening in said tool for attachment to a rotational driving apparatus, said opening being located opposite the working face, the axis of said opening being perpendicular to the flat working face of the tool, and support means including a rod and a rectangular shaped vertical sheet joined to the rod, the rod being mounted in said opening so that advertising material on the vertical sheet is displayed.

7. The assembly of claim 6, where the rotary tool is a rotatable brush.

8. The assembly of claim 6, wherein the vertical sheet includes means to hang up the assembly.

* * * * *